US006962625B2

(12) United States Patent
Bredesen

(10) Patent No.: US 6,962,625 B2
(45) Date of Patent: Nov. 8, 2005

(54) METHOD AND DEVICE FOR SEPARATE APPLICATION

(75) Inventor: Ronny Bredesen, Rasta (NO)

(73) Assignee: Dynea Chemicals Oy, Helsinki (FI)

( * ) Notice: Subject to any disclaimer, the term of this patent is extended or adjusted under 35 U.S.C. 154(b) by 5 days.

(21) Appl. No.: 10/725,923

(22) Filed: Dec. 3, 2003

(65) Prior Publication Data

US 2004/0134594 A1 Jul. 15, 2004

(30) Foreign Application Priority Data

Dec. 4, 2002 (NO) ..... 20025836

(51) Int. Cl.[7] ..... B05B 7/06; B05B 3/00

(52) U.S. Cl. ..... 118/313; 118/323; 118/501; 156/578

(58) Field of Search ..... 118/501, 313, 315, 118/323; 239/104, 106; 222/148; 156/578, 156/314, 315

(56) References Cited

U.S. PATENT DOCUMENTS 4,158,035 A * 6/1979 Haase et al. ..... 73/863.32
4,416,213 A 11/1983 Sakiya
4,419,141 A * 12/1983 Kunkel ..... 134/22.12
4,461,404 A 7/1984 Baughman et al.
4,489,856 A 12/1984 Baughman et al.
4,603,655 A 8/1986 Switall
6,463,716 B1 * 10/2002 Focke et al. ..... 53/370.3
6,827,782 B2 * 12/2004 Goto et al. ..... 118/667

FOREIGN PATENT DOCUMENTS

JP 59069173 4/1984
SE 373 525 2/1975

* cited by examiner

*Primary Examiner*—Chris Fiorilla
*Assistant Examiner*—Yewebdar Tadesse
(74) *Attorney, Agent, or Firm*—Nath & Associates PLLC; Gary M. Nath; Gregory B. Kang

(57) ABSTRACT

A device for application of a liquid gluing system comprising at least two components, such as a resin component and a hardener component, the device comprising at least two hollow members (11, 11'), each member being provided with a row of orifices designed to apply the respective components onto a substrate (6) below the hollow members (11, 11'), and at least two trays (2, 2') one tray below each of the hollow members to receive surplus of the respective component not being applied onto the substrate, wherein the hollow members (11, 11') are adapted to be placed in the respective tray (2, 2') having the orifices below the level of the liquid in the tray. A method for avoiding plugging of the orifices in the hollow member during a stop in application is also described.

16 Claims, 5 Drawing Sheets

METHOD AND DEVICE FOR SEPARATE APPLICATION

FIELD OF INVENTION

The present invention relates to the field of gluing and more specifically a method for avoiding plugging of orifices in an application head during stops in the application process and a device for performing the method.

BACKGROUND

Separate application of liquid resin and hardener components in the form of strands by means of an application device comprising two independently mounted application heads, each comprising a hollow member, such as a tube, having a row of orifices through which the resin and hardener components are separately spread after each other onto the substrate, is known e.g. from SE 373 525.

A process like the one described in SE 373 525 is used for production of different laminated wood based products such as laminated wood, laminated timber, glued-laminated wood, glulam, I-beam, KVH-beam, Duo- and Trio-beams.

Melamine-urea-formaldehyde (MUF), melamine-formaldehyde (MF) or phenol-resorcinol-formaldehyde (PRF) glue systems are the most used systems for production of the above mentioned laminated products.

During the application of glue and hardener, the substrate to be glued is moved under the application heads, normally by means of conveyors or the like. Surplus glue and hardener is recovered in trays under each application head and is recirculated by means of pumps and piping to the respective application head. The liquid hardener or glue is preferably filtered either by means of a filter in the trays or in separate filtration units.

A problem with the kind of device described in SE 373 525 is that the hardener and/or glue dries and stops the orifices in the application heads during a short or long stop in the production. The application heads therefore have to be dismounted from the device and cleaned to remove remaining glue or hardener from the application heads for longer scheduled or not scheduled stops. The maximum allowed stand still time without having to wash the heads to avoid that the orifices are stopped may vary from hardener to hardener or from one glue to another.

Washing of the application heads is undesirable as it is an extra working operation adding cost to the gluing process. Resin and hardener may include products that require special provisions to avoid an unacceptable working environment. The components of the glue system and/or detergents do also normally include environmental harmful ingridiences. Accordingly, the remains from the washing and washing water have to be handled as a special waste and be deposited. This special handling and extra processes adds complexity and cost to the application process.

Devices for avoiding drying out and/or stopping of nozzles are known from U.S. Pat. Nos. 4,416,213, 4,489,856 and JP 59069173.

According to U.S. Pat. No. 4,416,213 a cup filled with solvent vapor is fitted to the lower end of a nozzle when not in use in an apparatus for rotary coating, to avoid evaporation of solvent resulting in change of viscosity in the liquid in the nozzle.

U.S. Pat. No. 4,489,856 relates to a methods and apparatus where a nozzle for applying an air-curable adhesive normally is located in a storage position having the end of the nozzle inserted into a liquid in the sump, and where the nozzle is lifted out of the sump, the sump is moved and the nozzle is moved to a position for applying the adhesive.

JP 59069173 relates to a device for application of a self-hardenable viscous liquid to a surface, wherein the nozzle is immersed in a hardening inhibiting liquid when it is not in use.

The above-identified prior art all relates to single nozzles and devices for applying one component coating or glue. The references do not disclose or suggest methods or devices for application of glue by means of applicators having a plurality of nozzles or devices for application of gluing systems where a resin component and a hardener component are applied separately.

SUMMARY OF THE INVENTION

A goal for the present invention is to avoid the problems related to the components of a glue system drying out and stopping the orifices in the hollow members used for application of the components of the glue system.

According to a first aspect of the present invention there is provided a device for application of a liquid gluing system comprising at least two components, such as a resin component and a hardener component, the device comprising at least two hollow members, each member being provided with a row of orifices designed to apply the respective components onto a substrate below the hollow members, and at least two trays one tray below each of the hollow members to receive surplus of the respective component not being applied onto the substrate, wherein the hollow members are adapted to be placed in the respective tray having the orifices below the level of the liquid in the tray.

According to a preferred embodiment, the hollow members are removable connected to arms supporting the hollow members during application of the components.

It is also preferred that the hollow members are connected to the arms by means of brackets connected to the hollow members. This makes the connection and disconnection of the hollow member to the arm easier and more convenient.

It is also preferred that a lid for covering the opening of the tray is connected to the hollow member. The lid has no function during the application of the respective components but is used to a lid to cover the opening of the tray when the hollow member is placed in the tray.

According to an alternative embodiment the device comprises means for lowering the hollow member to placed in the respective tray during a stop in application. The height of the arms may be adjusted by any suitable means mechanically or hydraulically to place the hollow member in the tray.

According a second aspect the present invention relates to a method for avoiding plugging one or more orifices in a row of orifices in a hollow member for application of a component of a glue system to a substrate below the hollow member and where excess component is collected by means of a tray placed below the hollow member, wherein the hollow member during a stop in the application, is placed in the respective tray so that the row of orifices at the hollow member is below the level of liquid in the tray.

It is preferred that the hollow member is manually disconnected from a support member for supporting the hollow member during application and placed into the tray.

SHORT DESCRIPTION OF THE FIGURES

FIG. 1 is a side view of a preferred device for separate application of glue and hardener according to the invention seen across the direction of transportation of the substrate to be coated, FIG. 2 is a side view of the same device as illustrated in FIG. 2 seen in the direction of transportation of the substrate to be coated, FIG. 3 corresponds to FIG. 1 during the process of moving the application heads;

DETAILED DESCRIPTION

Figure 1:
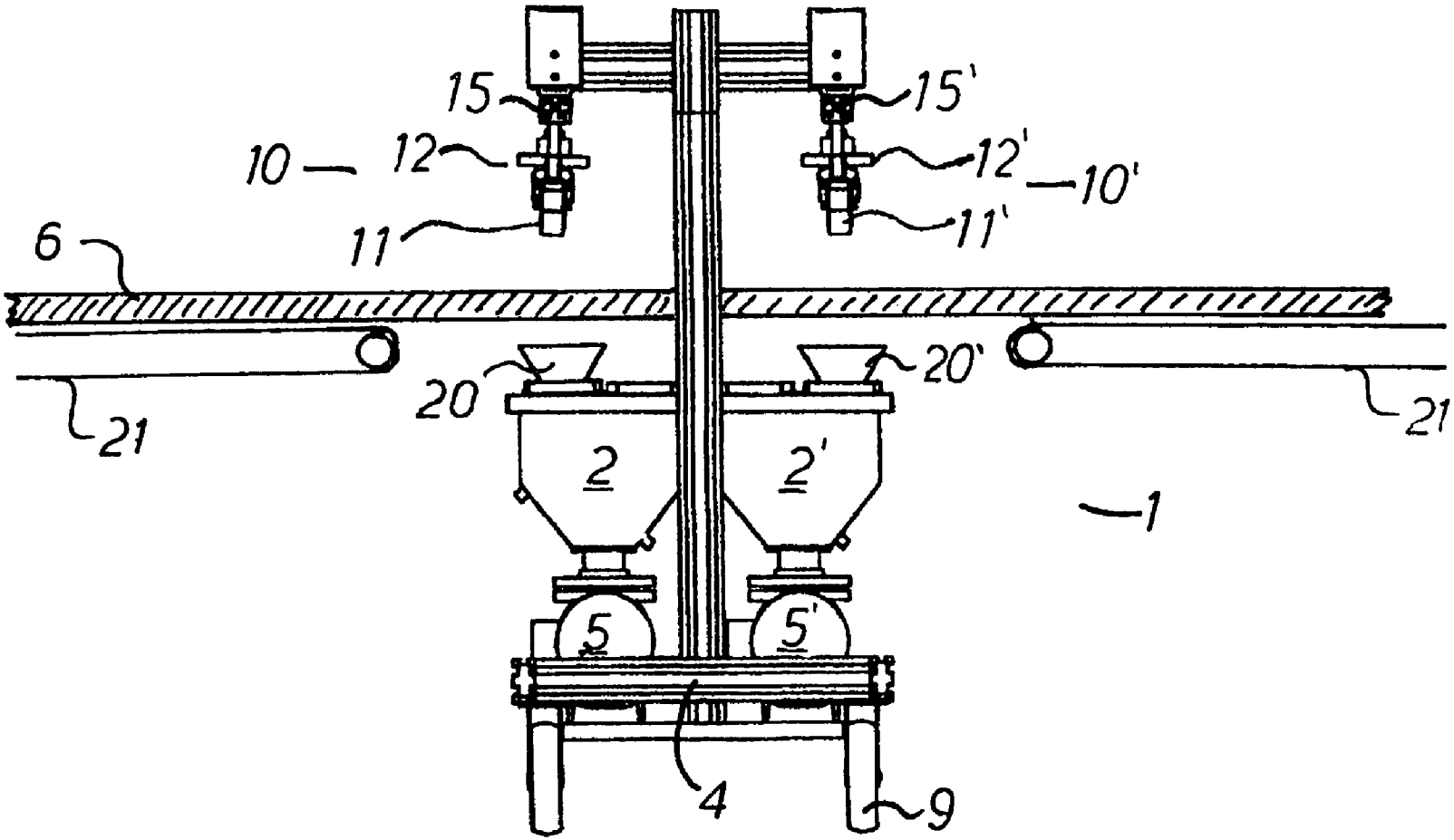
Figure 2:
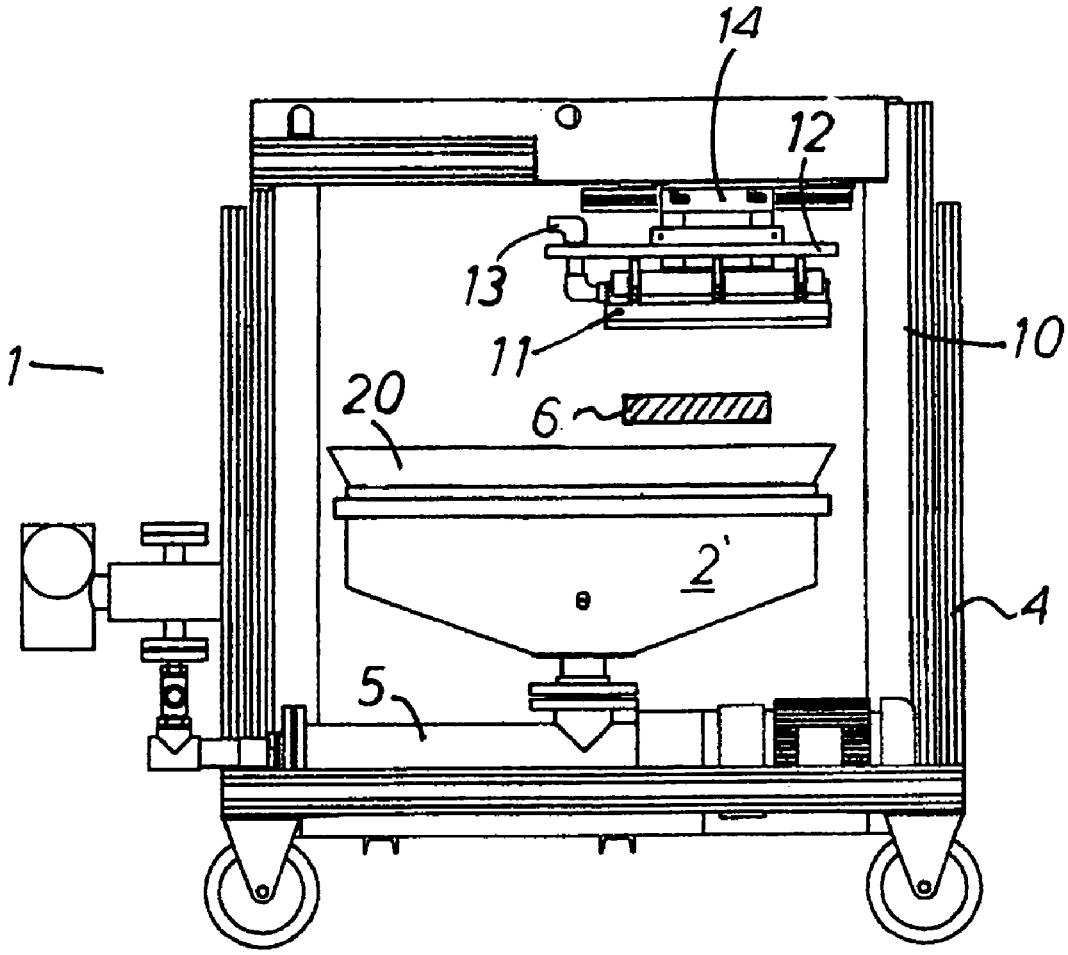
Figure 3:
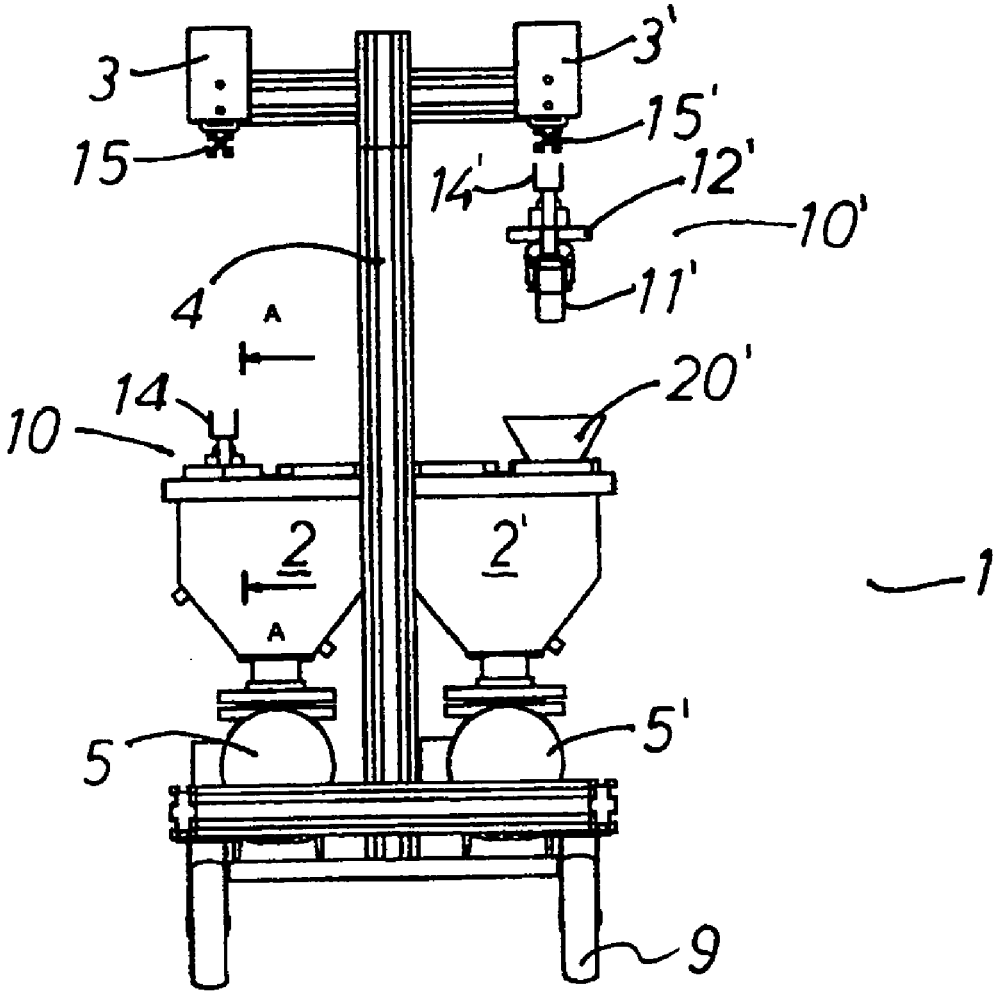

The figures illustrate a preferred embodiment of a device 1 for separate application of fluid glue and hardener according to the present invention. Glue and hardener are appplied from application heads 10, 10' against a substrate, such as a lamella 6 to be glued, that is passed below the application heads 10, 10'. The lamella 6 is transported by means of any suitable transporting means such as the illustrated conveyors 21, 21'.

The glue and hardener are preferably applied as strings that are formed by rows of not shown orifices or nozzles on the application heads as illustrated in SE373 525. Surplus glue that is not deposited at the lamellas is collected in trays 2, 2' below the application heads 10, 10' and the lamella 6. Funnels 20, 20' may be placed in the opening of the trays, or the opening may be funnel shaped, to increase the area of the opening and to reduce the loss of glue or hardener outside the trays.

Glue and hardener, collected in the trays 2, 2', are recirculated by means of pumps 5, 5', respectively, to the application heads 10, 10'. Hardener and glue are supplied from not shown supply lines, to make up for the amounts applied to the lamellas and any loss to keep the level in the trays at a predetermined level. The trays both serve as a reservoir for glue and hardener, respectively, and to receive excess glue or hardener from the application heads.

The application heads 10, 10' are detachably attached to horizontal arms 15, 15'. The arms 15, 15' are supported by support members 3, 3', and are movable in a direction mainly perpendicular to the direction of movement of the lamellas, seen from above. The movement of the arms makes it possible to adjust the position of the application heads relative to hit the lamella below the application head, or to move the application head to the side of the lamella to give a blind lamella, or a lamella without glue and hardener.

The arm may be moved by any suitable means, either by mechanical, electrically or hydraulically means.

The application heads 10, 10' comprises at its lower end a hollow member 11, 11', and a fastening bracket 14, 14' at its top end. The hollow member, 11, 11', is preferably a tube having a row of orifices or nozzles directed downwards, as illustrated in SE 373 525. The hollow member 11, 11' is connected to a not shown flexible hose via hose connection 13. The flexible hose is connected to the pump 5, 5' for supplying glue or hardener to the hollow member. A cover 12, 12' is preferably provided over the hollow member 11, 11'.

The fastening bracket 14, 14' is adapted to be removable connected to the arm 15, 15'. The connection between the fastening bracket 14, 14' and the arm 15, 15' may achieved be any suitable means well known for the skilled man in the art.

The illustrated device comprises a rack 4 for supporting the parts of the device. The illustrated rack has wheel 9 for transportation of the device in a production plant.

Figure 4:
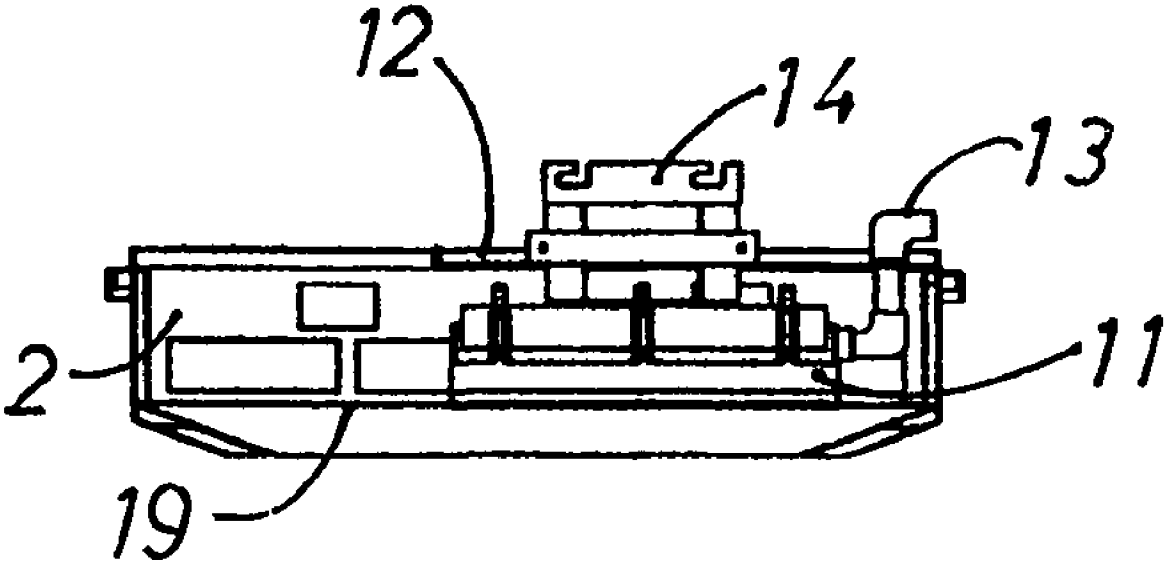
FIG. 4 is the cross section indicated by A—A in FIG. 3.
Figure 5:
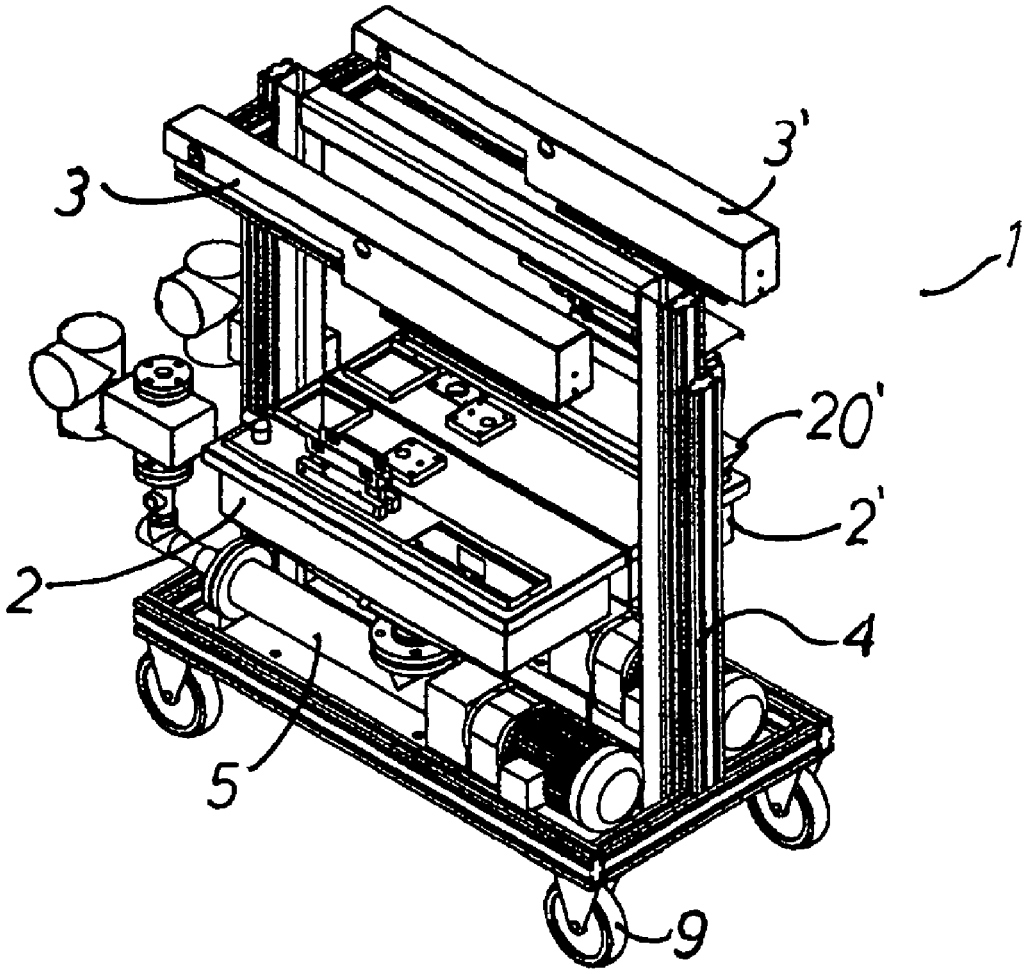
FIG. 5 is a perspective view of the present device.

When the plant is to be stopped for example over night, the application heads 10, 10' are disconnected from the arms 15, 15' and placed in the trays 2, 2' so that the orifices or nozzles on the hollow members, 11, 11', is below the level of liquid, indicated by the line 19 in FIG. 4, in the trays and the cover 12, 12' serves as a lid or a part of a lid for the tray 2, 2'.

The present invention is described by means of a preferred embodiment for application of a two component gluing system. It will be apparent for the skilled man in the art that the system is also applicable for multi component systems having more than two parallel application systems. The skilled man in the art will also understand that more than one application head may be used for each component.

What is claimed is:

1. A device for application of a liquid gluing system comprising at least two components, such as a resin component and a hardener component, the device comprising at least two hollow members (11, 11'), each member being provided with a row of orifices designed to apply the respective components onto a substrate (6) below the at least two hollow members (11, 11'), and at least two trays (2, 2') one tray below each of the at least two hollow members to receive surplus of the respective component not being applied onto the substrate, wherein the at least two hollow members (11, 11') are adapted to be placed in the respective at least two trays (2, 2') having the orifices below the level of the liquid in the at least two trays.

2. The device according to claim 1, wherein the at least two hollow members are removably connected to arms (15, 15') supporting the at least two hollow members during application of the components.

3. The device according to claim 1, wherein the at least two hollow members are connected to the arms by means of brackets connected to the at least two hollow members.

4. The device according to claim 1, wherein lids (12, 12') for covering the opening of the at least two trays (2, 2') are connected to the at least two hollow members.

5. The device according to claim 1, wherein the device comprises means for lowering the at least two hollow members to be placed in the respective at least two trays during a stop in application.

6. The device according to claim 2, wherein the at least two hollow members are connected to the arms by means of brackets connected to the at least two hollow members.

7. The device according to claim 2, wherein lids (12, 12') for covering the opening of the at least two trays (2, 2') are connected to the at least two hollow members.

8. The device according to claim 3, wherein lids (12, 12') for covering the opening of the at least two trays (2, 2') are connected to the at least two hollow members.

9. The device according to claim 6, wherein lids (12, 12') for covering the opening of the at least two trays (2, 2') are connected to the at least two hollow members.

10. The device according to claim 2, wherein the device comprises means for lowering the at least two hollow members to be placed in the respective at least two trays during a stop in application.

11. The device according to claim 3, wherein the device comprises means for lowering the hollow at least two hollow members to be placed in the respective at least two trays during a stop in application.

12. The device according to claim 4, wherein the device comprises means for lowering the at least two hollow members to be placed in the respective at least two trays during a stop in application.

13. The device according to claim 6, wherein the device comprises means for lowering the hollow at least two hollow members to be placed in the respective at least two trays during a stop in application.

14. The device according to claim 7, wherein the device comprises means for lowering the hollow at least two hollow members to be placed in the respective at least two trays during a stop in application.

15. The device according to claim 8, wherein the device comprises means for lowering the at least two hollow members to be placed in the respective at least two trays during a stop in application.

16. The device according to claim 9, wherein the device comprises means for lowering the at least two hollow members to be placed in the respective at least two trays during a stop in application.

* * * * *